US006162097A

United States Patent [19]

Liang

[11] Patent Number: 6,162,097

[45] Date of Patent: Dec. 19, 2000

[54] FUSE BOX

[76] Inventor: Shih-Tsung Liang, No.10, Lane 31, Ta-Feng St., Neitsou Tsun, Luchu Hsiang, Taoyuan County, Taiwan

[21] Appl. No.: 09/398,095

[22] Filed: Sep. 17, 1999

[51] Int. Cl.[7] ..... H01R 13/68; H01R 27/00

[52] U.S. Cl. ..... 439/621; 439/218

[58] Field of Search ..... 439/621, 622, 439/801, 830, 831, 832, 833, 218, 222, 698; 337/198, 228

[56] References Cited

U.S. PATENT DOCUMENTS 5,618,209 4/1997 Lin et al. ..... 439/621

5,888,098 3/1999 Cheng et al. ..... 439/621

6,004,159 12/1999 Liang ..... 439/621

*Primary Examiner*—Brian Sircus

*Assistant Examiner*—Chandrika Prasad

*Attorney, Agent, or Firm*—Rosenberg, Klein & Lee

[57] ABSTRACT

A fuse box, which includes a bottom shell, a plurality of conducting blocks respectively mounted on the bottom shell and arranged in parallel at two sides and electrically connected to two opposite ends of a power circuit, each conducting block having cartridge fuse clamp for holding one terminal of a cartridge fuse, and a plug fuse clamp suspended below the cartridge fuse clamp for holding one plug pin of a plug fuse, and a cover shell covered on the bottom shell over the conducting blocks, the cover shell having a plurality of top insertion holes for the insertion of a respective plug fuse.

11 Claims, 7 Drawing Sheets

FUSE BOX

BACKGROUND OF THE INVENTION

The present invention relates to a fuse box, and more particularly to such a fuse box, which is practical for use with cartridge fuses as well as plug fuses.

FIG. 9 shows a fuse box according to the prior art. This structure of fuse box comprises a bottom shell 5, a cover shell 51 covered on the bottom shell 5, a plurality of conducting blocks 6 respectively mounted on the bottom shell 5 and arranged in parallel at two sides, each conducting block 6 having a front locating flange 61, a plurality of electric wires 63 respectively fastened to the conducting blocks 6, and a plurality of metal spring clamps 62 respectively fastened to the conducting blocks 6 for holding cartridge fuses 3. Each metal spring clamp 62 has a flat bottom 15 wall 621 fixedly fastened to the front locating flange 61 of one conducting block 6 by a screw 611, and two curved clamping arms 622 for holding down one terminal 31 of a cartridge fuse. FIGS. 10 and 11 show another structure of fuse box according to the prior art. This structure of fuse box comprises a bottom shell 5, a cover 20 shell 51 covered on the bottom shell 5, a plurality of conducting blocks 7 respectively mounted on the bottom shell and arranged in parallel at two sides, a plurality of electric wires 71 respectively fastened to the conducting blocks 7 by a respective holding down screw, and a plurality of plug fuse clamps 8 respectively fastened to the conducting blocks 7 by a respective screw 82. Each plug fuse clamp 8 having two clamping strips 81 for holding down one plug pin 41 of a plug fuse 4.

U.S. Ser. No. 09/062,999 discloses still another structure of fuse box. This structure of fuse box comprises a plurality of conducting blocks arranged on a bottom shell of the fuse box, each conducting block having a cartridge fuse clamp for holding one terminal of a cartridge fuse.

The aforesaid known fuse boxes commonly designed for use with a particular fuse. One fuse box, which is designed for use with cartridge fuses (or plug fuses), cannot be used with plug fuses (or cartridge fuses).

SUMMARY OF THE INVENTION

1. The present invention has been accomplished to provide a fuse box, which is practical for use with cartridge fuses as well as plug fuses. According to one aspect of the present invention, the fuse box comprises a bottom shell, a plurality of conducting blocks respectively mounted on the bottom shell and arranged in parallel at two sides and electrically connected to two opposite ends of a power circuit, each conducting block having cartridge fuse clamp or holding one terminal of a cartridge fuse, and a plug fuse clamp suspended below the cartridge fuse clamp for holding one plug pin of a plug fuse, and a cover shell covered on the bottom shell over the conducting blocks, the cover shell having a plurality of top insertion holes for the insertion of a respective plug fuse. According to another aspect of the present invention, the cartridge fuse clamp of each conducting blocks comprises a longitudinally extended bottom slot for the passing of one plug pin of a plug fuse. According to still another aspect of the present invention, each cartridge fuse clamp of each conducting block comprises a plurality of vertical splits symmetrically disposed at two opposite lateral sides thereof, which enhance the spring power of the cartridge fuse clamp. According to still another aspect of the present invention, each clamping strip of the plug fuse clamp of each conducting block has a longitudinal split on the middle, which enhances the spring power of the respective clamping strip.

DETAILED DESCRIPTION OF THE PREFERRED EMBODIMENTS

Figure 1:
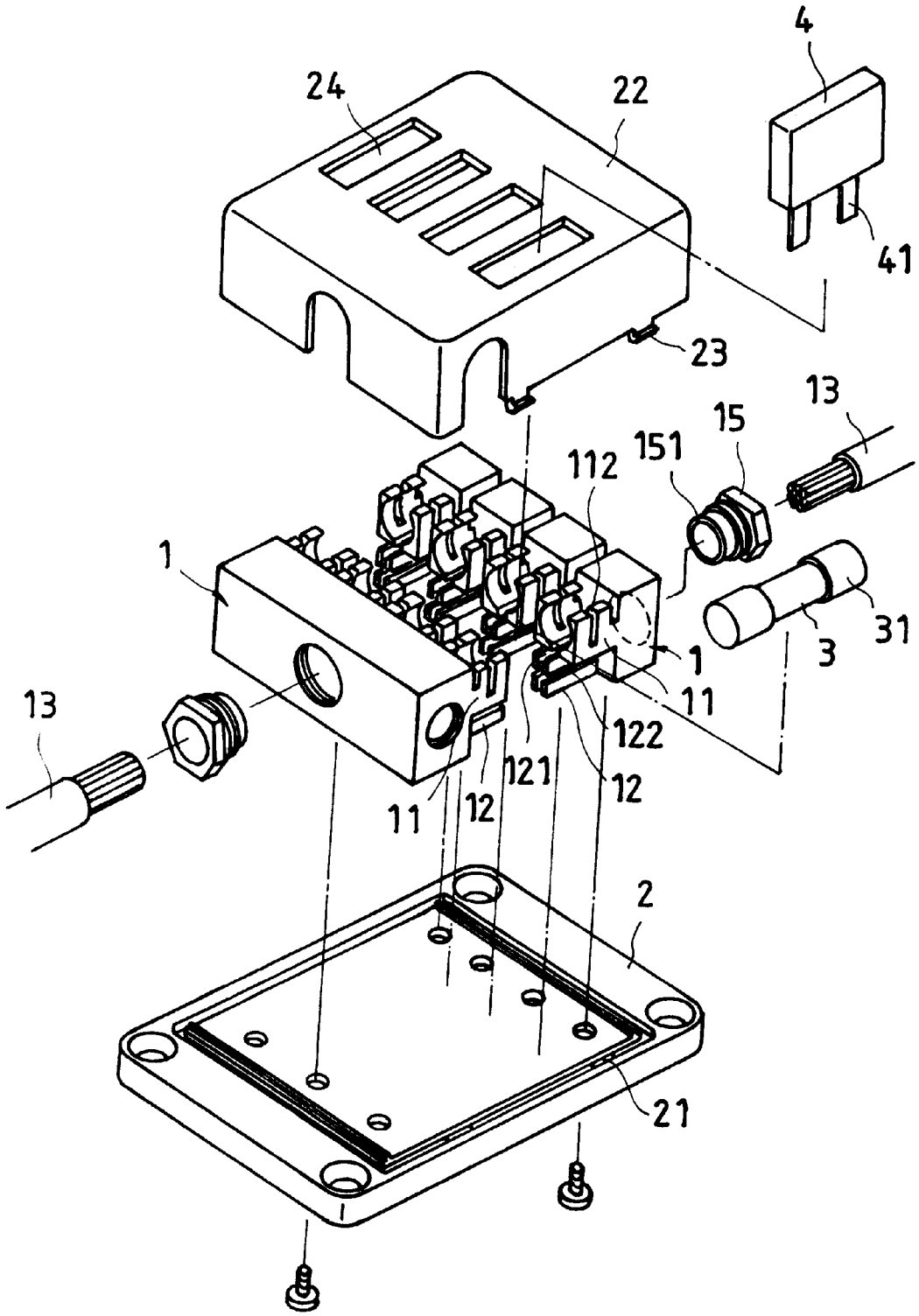
FIG. 1 is an exploded view of a multi-fuse fuse box according to the present invention.
Figure 2:
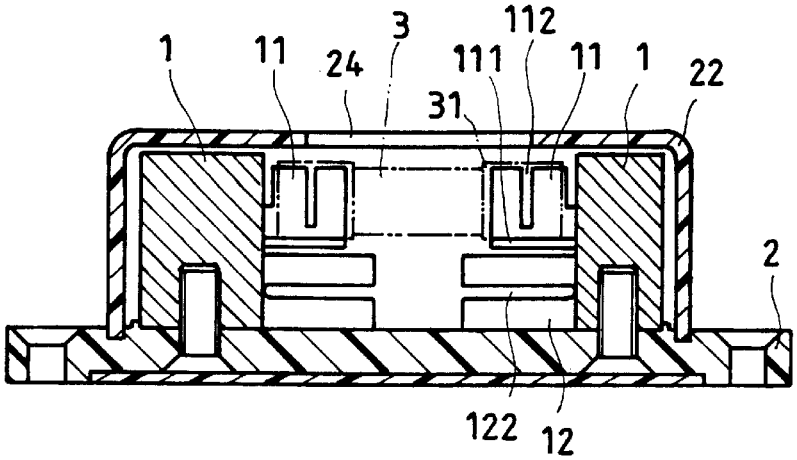
FIG. 2 is a sectional plain view showing the installation of a cartridge fuse in the fuse box according to the present invention.
Figure 3:
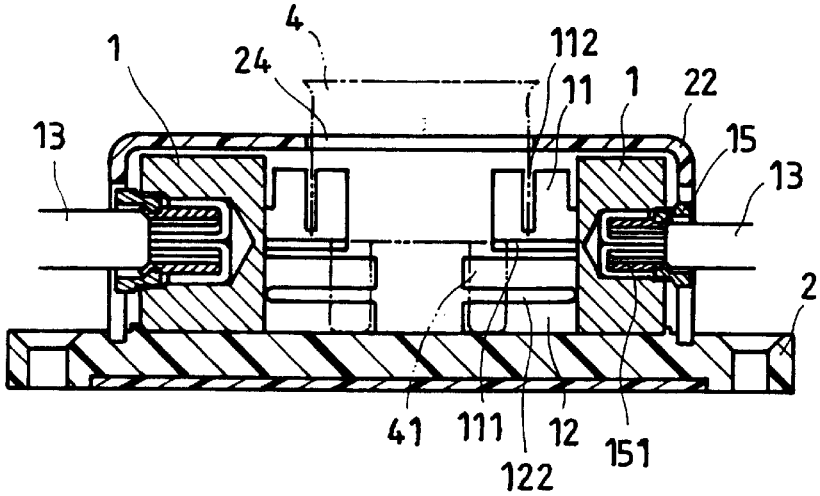
FIG. 3 is a sectional plain view showing the installation of a plug fuse in the fuse box.
Figure 4:
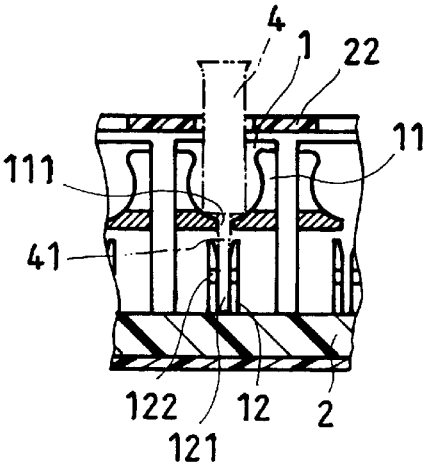
FIG. 4 is a sectional view of a part of the present invention, showing one plug pin of plug fuse fastened to the plug fuse clamp.

Referring to FIGS. from 1 through 4, a fuse box according to the present invention is shown comprised of a bottom shell 2, a cover shell 22 covered on the bottom shell 2, a plurality of conducting blocks 1 mounted on the top side wall of the bottom shell 2 and arranged in parallel at two sides, a plurality of electric wires 13 respectively fastened to the conducting blocks 1 by a respective screw cap 15 and a respective wire binding ring 151, and a plurality of cartridge fuses 3 and/or plug fuses 4 respectively connected between the conducting blocks 1. The conducting blocks 1 each comprise a cartridge fuse clamp 11 for holding one terminal 31 of a cartridge fuse 3, and a plug fuse clamp 12 suspended below the cartridge fuse clamp 11 for holding one plug pin 41 of a plug fuse 4. The cartridge fuse clamp 11 has a smoothly arched cross section fitting the periphery of the cylindrical terminals 31 of a cartridge fuse 3, a plurality of vertical splits 112 symmetrically disposed at two opposite lateral sides, which enhance the spring power of the cartridge fuse clamp 11, enabling one terminal 31 of a cartridge fuse 3 to be conveniently inserted into the cartridge fuse clamp 11 and then positively secured in position after its insertion, and a longitudinally extended bottom slot 111 through which one plug pin 41 of a plug fuse 4 can be inserted and fastened to the plug fuse clamp 12. The plug fuse clamp 12 comprises two parallel clamping strips 121 for clamping on the plug pin 41 of a plug fuse 4 inserted therein. The clamping strips 121 each have a longitudinally extended split 122 on the middle, which enhance the spring power of the clamping strips 121. The bottom shell 2 comprises a plurality of hook holes 21 for the positioning of the cover shell 22. The cover shell 22 comprises a plurality of bottom mounting hooks 23 respectively hooked in the hook holes 21 at the bottom shell 2, and a plurality of top insertion holes 24 for the installation of plug fuses 4.

Figure 5:
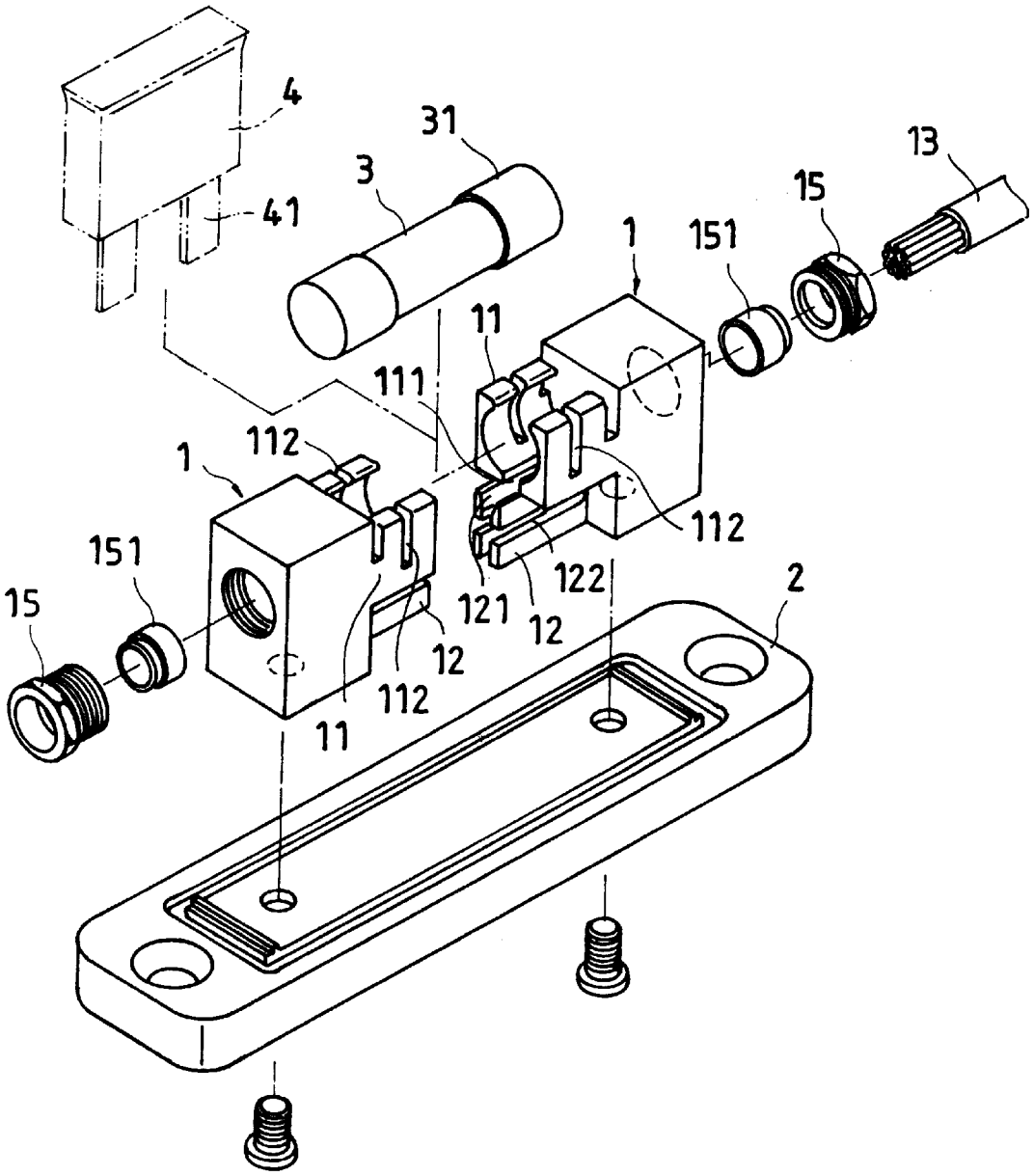
FIG. 5 is an exploded view of a single-fuse fuse box according to the present invention (the cover shell excluded).

FIG. 5 shows an alternate form of the present invention. This design comprises only one pair of conducting blocks 1 arranged for holding one cartridge fuse 3 or plug fuse 4 only.

Figure 6:
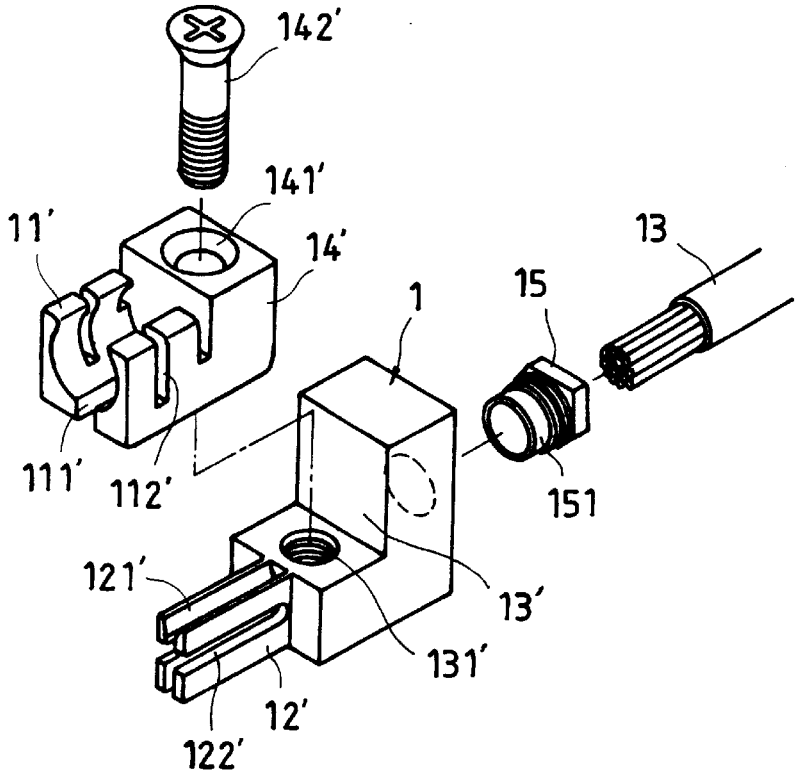
FIG. 6 is an exploded view of a part of an alternate form of the present invention.

Referring to FIG. 6, the conducting block, referenced by 1', comprises a plug fuse clamp 12' forwardly extended from a front side thereof at the bottom, an angled cut 13' at the front side, and a vertical screw hole 131' at a horizontal wall in the angled cut 13'. An electric wire 13 is fastened to the conducting block 1' at the backside by a screw cap 15 and a wire finding ring 151. The plug fuse clamp 12' is comprised of two parallel clamping strips 121', each clamping strip 121' having a longitudinal split 122' on the middle. A metal mounting block 14' is fastened to the conducting block 1' in the angled cut 13', having a vertical mounting hole 141' connected to the screw hole 131' at the horizontal wall in the angled cut 13' of the conducting block 1' by a screw 142', and a cartridge fuse clamp 11' extended from a front side wall thereof and suspended above the plug fuse clamp 12' of the conducting block 1'. The cartridge fuse clamp 11' comprises a plurality of vertical splits 112' symmetrically disposed at two opposite lateral sides, and a longitudinally extended bottom slot 111 '.

Figure 7:
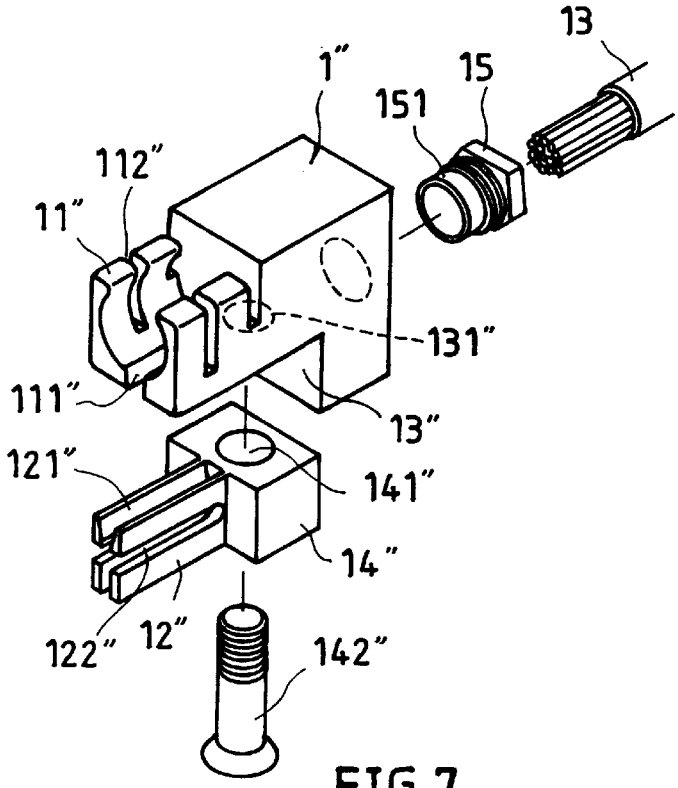
FIG. 7 is an exploded view of a part of still another alternate form of the present invention.

Referring to FIG. 7, the conducting block, referenced by 1", comprises a cartridge fuse clamp 11" forwardly extended from a front side thereof, an angled cut 13" at the bottom, and a vertical bottom screw hole 131" at a horizontal wall in the angled cut 13". The plug fuse clamp 11" comprises a plurality of vertical splits 112" symmetrically disposed at two opposite lateral sides, and a longitudinally extended bottom slot 111". An electric wire 13 is fastened to the conducting block 1" at the backside by a screw cap 15 and a wire finding ring 151. A metal mounting block 14" is fastened to the conducting block 1" in the angled cut 13", having a vertical mounting hole 141" connected to the screw hole 131" at the horizontal wall in the angled cut 13" of the conducting block 1" by a screw 142", and a plug fuse clamp 12" extended from a front side wall thereof and suspended below the cartridge fuse clamp 11" of the conducting block 1". The plug fuse clamp 12" is comprised of two parallel clamping strips 121", each clamping strip 121" having a longitudinal split 122" on the middle.

Figure 8:
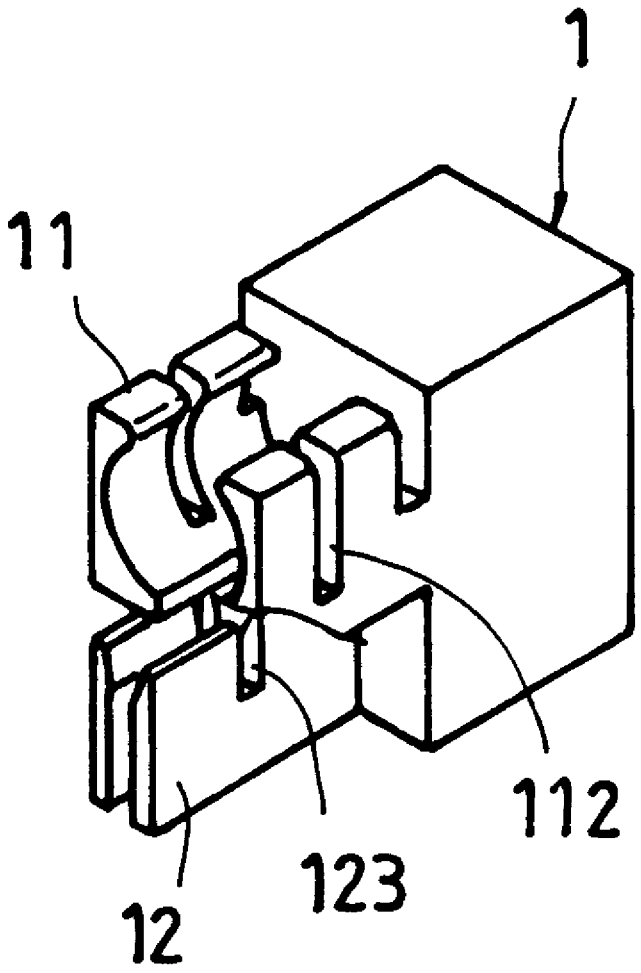
FIG. 8 is an elevational view of an alternate form of the conducting block according to the present invention, showing vertical splits formed on the clamping strips of the plug fuse clamp.
Figure 9:
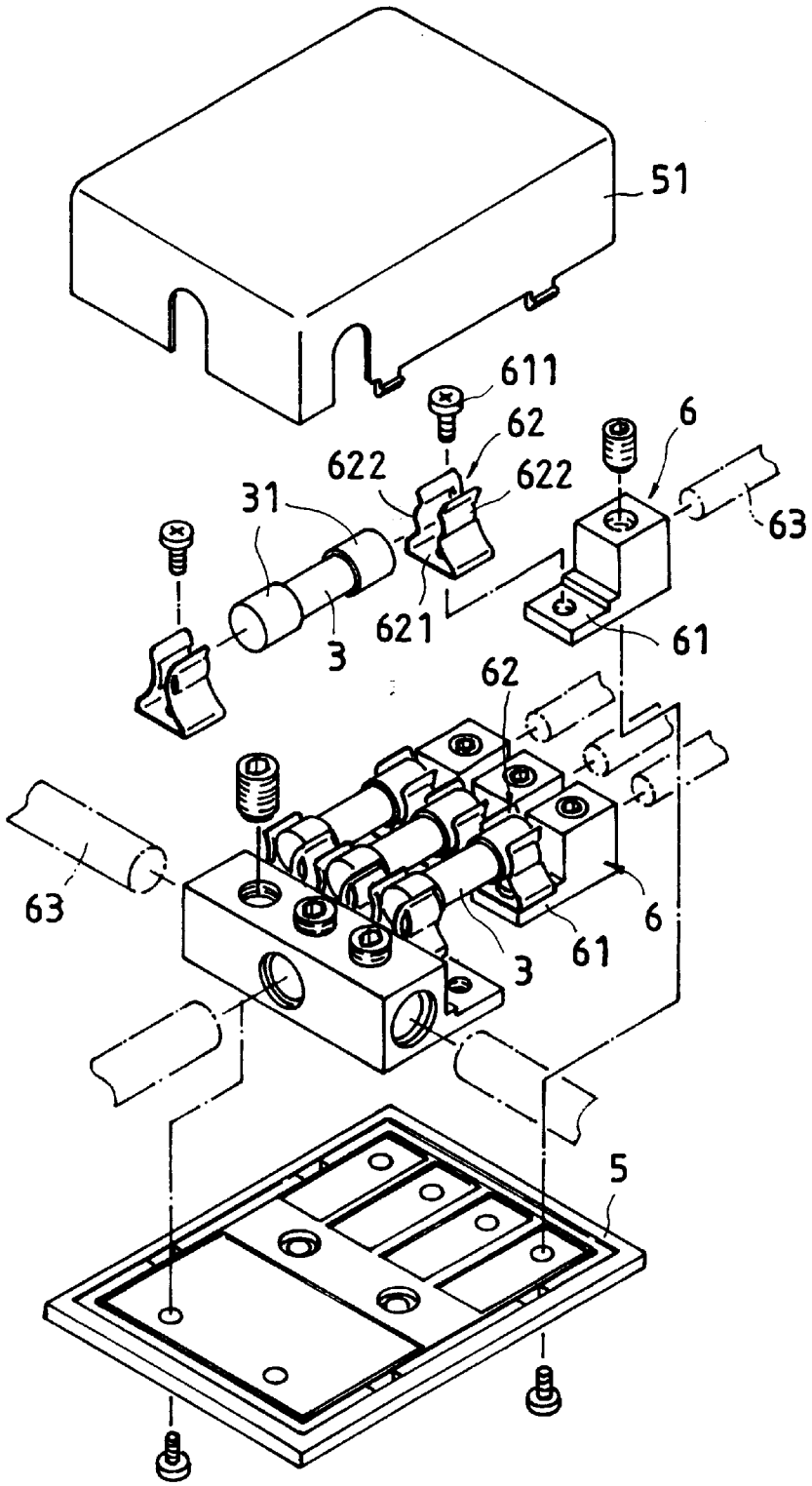
FIG.9 PRIOR ART
FIG. 9 is an exploded view of a cartridge fuse type fuse box according to the prior art.
Figure 10:
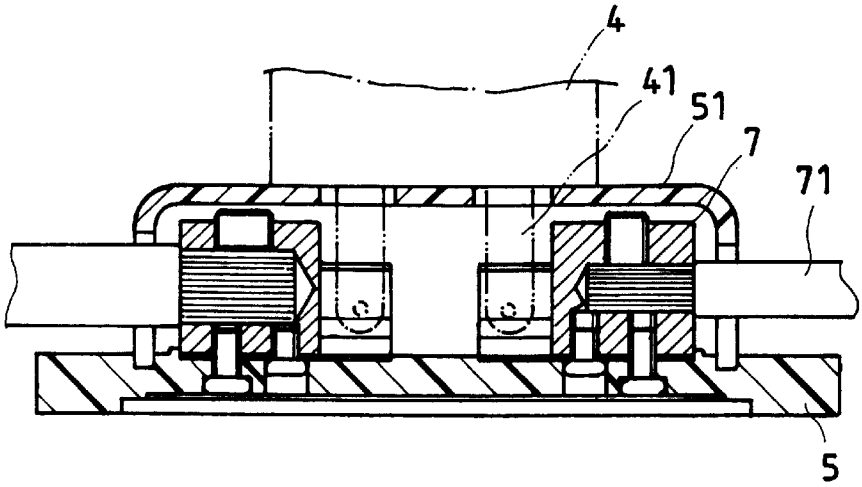
FIG.10 PRIOR ART
FIG. 10 is a sectional view of a plug fuse type fuse box according to the prior art.
Figure 11:
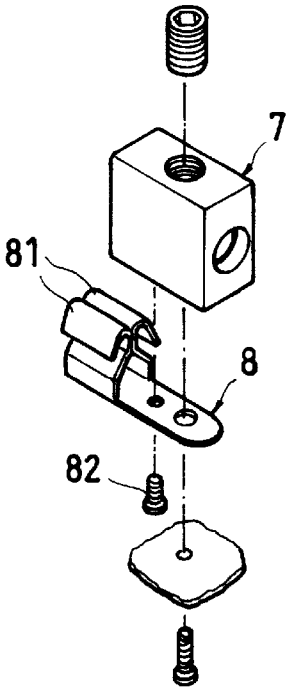
FIG.11 PRIOR ART
FIG. 11 is an exploded view of a part of the plug fuse type fuse block shown in FIG. 10.

Referring to FIG. 8, the plug fuse clamp 12 of the conducting block 1 is shown having a transverse split 123 at each of the two parallel clamping strips thereof.

It is to be understood that the drawings are designed for purposes of illustration only, and are not intended for use as a definition of the limits and scope of the invention disclosed.

What the invention claimed is:

1. A fuse box comprising:

a bottom shell, said bottom shell comprising a plurality of plug holes;

a plurality of conducting blocks respectively mounted on said bottom shell and arranged in parallel at two sides and electrically connected to two opposite ends of a power circuit, said conducting blocks each comprising at least one cartridge fuse clamp for holding one terminal of a cartridge fuse respectively, and at least one plug fuse clamp respectively suspended below said at least one cartridge fuse clamp for holding one plug pin of a plug fuse respectively, said at least one cartridge fuse clamp each having a smoothly arched cross section fitting the periphery of the cylindrical terminals of a cartridge fuse, said at least one plug fuse clamp each comprising two parallel clamping strips for clamping on the plug pin of a plug fuse inserted therein; and a cover shell covered on said bottom shell over said conducting blocks, said cover shell comprising a plurality of bottom hooks respectively hooked in the hook holes at said bottom shell, and a plurality of top insertion holes for the insertion of a respective plug fuse.

2. The fuse box of claim 1 wherein each cartridge fuse clamp of each of said conducting blocks comprises a longitudinally extended bottom slot for the passing of one plug pin of a plug fuse.

3. The fuse box of claim 1 wherein each cartridge fuse clamp of each of said conducting blocks comprises a plurality of vertical splits symmetrically disposed at two opposite lateral sides thereof.

4. The fuse box of claim 1 wherein the clamping strips of each plug fuse clamp of each of said at least one conducting blocks each have a split extended in longitudinal direction on the middle.

5. The fuse box of claim 1 wherein the clamping strips of each plug fuse clamp of each of said at least one conducting blocks each have a split extended in transverse direction on the middle.

6. A fuse box comprising:

a bottom shell, said bottom shell comprising a plurality of plug holes;

a plurality of conducting blocks respectively mounted on said bottom shell and arranged in parallel at two sides and electrically connected to two opposite ends of a power circuit, said conducting blocks each comprising a plug fuse clamp at a front side thereof for holding one plug pin of a plug fuse, an angled cut at the front side, and a vertical screw hole at a horizontal wall in said angled cut, said plug fuse clamp comprising two parallel clamping strips each;

a plurality of metal mounting blocks respectively fastened to said conducting blocks in the angled cut at each of said conducting blocks, said metal mounting blocks each having a vertical mounting hole connected to the screw hole one conducting block by a screw, and a cartridge fuse clamp extended from a front side wall thereof and suspended above the plug fuse clamp of the corresponding conducting block for holding one plug pin of a plug fuse, said cartridge fuse clamp comprising a plurality of vertical splits symmetrically disposed at two opposite lateral sides, and a longitudinally extended bottom slot; and a cover shell covered on said bottom shell over said conducting blocks and said metal mounting blocks, said cover shell comprising a plurality of bottom hooks respectively hooked in the hook holes at said bottom shell, and a plurality of top insertion holes for the insertion of a respective plug fuse.

7. The fuse box of claim 6 wherein the clamping strips of the plug fuse clamp of each of said conducting blocks each have a split extended in longitudinal direction on the middle.

8. The fuse box of claim 6 wherein the clamping strips of the plug fuse clamp of each of said conducting blocks each have a split extended in transverse direction on the middle.

9. A fuse box comprising:

a bottom shell, said bottom shell comprising a plurality of plug holes;

a plurality of conducting blocks respectively mounted on said bottom shell and arranged in parallel at two sides and electrically connected to two opposite ends of a power circuit, said conducting blocks each comprising a cartridge fuse clamp at a front side thereof for holding one plug pin of a plug fuse, an angled cut at a bottom side thereof, and a vertical screw hole at a horizontal wall in said angled cut, said cartridge fuse clamp comprising a plurality of vertical splits symmetrically disposed at two opposite lateral sides, and a longitudinally extended bottom slot; and a plurality of metal mounting blocks respectively fastened to said conducting blocks in the angled cut at each of said conducting blocks, said metal mounting blocks each having a vertical mounting hole connected to the screw hole one conducting block by a screw, and a plug fuse clamp extended from a front side wall thereof and suspended below the cartridge fuse clamp of the corresponding conducting block for holding one plug pin of a plug fuse; and a cover shell covered on said bottom shell over said conducting blocks and said metal mounting blocks, said cover shell comprising a plurality of bottom hooks respectively hooked in the hook holes at said bottom shell, and a plurality of top insertion holes for the insertion of a respective plug fuse.

10. The fuse box of claim 9 wherein the clamping strips of the plug fuse clamp of each of said metal mounting blocks each have a split extended in longitudinal direction on the middle.

11. The fuse box of claim 6 wherein the clamping strips of the plug fuse clamp of each of said metal mounting blocks each have a split extended in transverse direction on the middle.

* * * * *